US007797895B1

(12) United States Patent
Sorkin

(10) Patent No.: US 7,797,895 B1
(45) Date of Patent: Sep. 21, 2010

(54) SHRINKAGE-PREVENTING DEVICE FOR THE SHEATHING OF A TENDON

(76) Inventor: Felix L. Sorkin, 13022 Trinity Dr., Stafford, TX (US) 77477

( * ) Notice: Subject to any disclaimer, the term of this patent is extended or adjusted under 35 U.S.C. 154(b) by 296 days.

(21) Appl. No.: 11/933,029

(22) Filed: Oct. 31, 2007

Related U.S. Application Data

(63) Continuation-in-part of application No. 11/861,185, filed on Sep. 25, 2007.

(51) Int. Cl.
*E04C 5/08* (2006.01)

(52) U.S. Cl. ..... 52/223.13; 403/314; 403/367; 403/369; 403/374.1

(58) Field of Classification Search ..... 52/223.13; 403/304, 314, 365, 367, 368, 369, 374.1; 24/122.6, 122.3, 459, 136 R, 115 M
See application file for complete search history.

(56) References Cited

U.S. PATENT DOCUMENTS 274,796 A * 3/1883 Loehner ..... 403/314
833,548 A * 10/1906 Putnam ..... 403/368
1,646,660 A * 10/1927 Prince ..... 439/805
2,166,458 A * 7/1939 Berndt et al. ..... 439/788
3,534,989 A * 10/1970 Yonkers ..... 403/369
3,596,330 A * 8/1971 Scott et al. ..... 24/122.3
3,698,749 A * 10/1972 Yonkers ..... 403/197
4,494,890 A * 1/1985 Lusk ..... 403/267
4,619,088 A * 10/1986 Ripoll Garcia-Mansilla ..... 52/223.13
5,469,677 A * 11/1995 Luthi ..... 52/223.13
5,630,301 A * 5/1997 Sieg ..... 52/223.13
5,770,286 A 6/1998 Sorkin
5,839,235 A 11/1998 Sorkin
5,897,102 A * 4/1999 Sorkin ..... 254/29 A
6,098,356 A 8/2000 Sorkin
6,381,912 B1 5/2002 Sorkin
6,513,287 B1 2/2003 Sorkin
6,631,596 B1 10/2003 Sorkin
6,817,148 B1 11/2004 Sorkin

* cited by examiner

*Primary Examiner*—Brian E Glessner
(74) *Attorney, Agent, or Firm*—Egbert Law Offices PLLC

(57) ABSTRACT

A device for fixing the sheathing of an end of a tendon within an anchor body of a post-tension anchor system has an anchor body having a cavity formed in an interior thereof, a tendon extending into the cavity having a sheathing extending at least partially thereover and having a sheathed portion and an unsheathed portion, a pair of wedges in engagement with the unsheathed portion of the tendon in the cavity of the anchor body, and at least one wedge member engaged with the sheathed portion. The wedge member has a wide end and a narrow end, the wide end being adjacent to the pair of wedges. The wedge member has a decreasing thickness from the wide end to the narrow end.

15 Claims, 2 Drawing Sheets

SHRINKAGE-PREVENTING DEVICE FOR THE SHEATHING OF A TENDON

CROSS-REFERENCE TO RELATED APPLICATIONS

The present application is a continuation-in-part of U.S. application Ser. No. 11/861,185 filed on Sep. 25, 2007, and entitled "Apparatus for Preventing Shrinkage of a Sheathing Over a Tendon", presently pending.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to post tension anchor systems. More particularly, the present invention relates to dead-end anchors used in such post-tension systems. More particularly, the present invention the present invention relates to devices and methods used to prevent shrinkage of a sheathing that extends over the tendon.

2. Description of Related Art Including Information Disclosed Under 37 CFR 1.97 and 37 CFR 1.98.

For many years, the design of concrete structures imitated the typical steel design of column, girder and beam. With technological advances in structural concrete, however, concrete design began to evolve. Concrete has the advantages of costing less than steel, of not requiring fireproofing, and of having plasticity, a quality that lends itself to free flowing or boldly massive architectural concepts. On the other hand, structural concrete, though quite capable of carrying almost any compressive load, is weak in carrying significant tensile loads. It becomes necessary, therefore, to add steel bars, called reinforcements, to concrete, thus allowing the concrete to carry the compressive forces and the steel to carry the tensile forces.

Structures of reinforced concrete maybe constructed with load-bearing walls, but this method does not use the full potentialities of the concrete. The skeleton frame, in which the floors and roofs rest directly on exterior and interior reinforced-concrete columns, has proven to be most economical and popular. Reinforced-concrete framing is seemingly a simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, comprising a mixture of water, cement, sand, and stone or aggregate and having proportions calculated to produce the required strength, is set, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as five hundred feet can be attained in members as deep as three feet for roof loads. The basic principle is simple. In pre-stressing, reinforcing tendons of high tensile strength wires are stretched to a certain determined limit and then high-strength concrete is placed around them. When the concrete has set, it holds the steel in a tight grip, preventing slippage or sagging. Post-tensioning follows the same principle, but the reinforcing tendon, usually a steel cable, is held loosely in place while the concrete is placed around it. The reinforcing tendon is then stretched by hydraulic jacks and securely anchored into place. Pre-stressing is done with individual members in the shop and post-tensioning as part of the structure on the site.

In a typical tendon tensioning anchor assembly used in such post-tensioning operations, there are provided anchors for anchoring the ends of the cables suspended therebetween. In the course of tensioning the cable in a concrete structure, a hydraulic jack or the like is releasably attached to one of the exposed ends of each cable for applying a predetermined amount of tension to the tendon, which extends through the anchor. When the desired amount of tension is applied to the cable, wedges, threaded nuts, or the like, are used to capture the cable at the anchor plate and, as the jack is removed from the tendon, to prevent its relaxation and hold it in its stressed condition.

In typical post-tension systems, the tendon is received between a pair of anchors. One of the anchors is known as the "live-end" anchor, and the opposite end is known as the "dead-end" anchor. The "live-end" anchor receives the end of the tendon which is to be tensioned. The "dead-end" anchor holds the tendon in place during the tensioning operation. Under typical operations, a plurality of wedges are inserted into an interior passageway of the anchor and around the exterior surface of the tendon. The tendon is then tensioned so as to draw the wedges inwardly into the interior passageway so as establish compressive and locking contact with an exterior surface of the tendon. This dead-end anchor can then be shipped, along with the tendon, for use at the job site.

One technique for forming such dead-end anchors is to insert the end of a tendon into the cavity of the anchor, inserting wedges into the space between the tendon and the wall of the cavity and then applying a tension force onto another end of the tendon so as to draw the wedges and the end of the tendon into the cavity in interference-fit relationship therewith. This procedure is somewhat difficult since the tendon can have a considerable length and since the use of tension forces can create a somewhat unreliable connection between the wedges and the tendon. Experimentation has found that the application of compressive force onto the end of the tendon creates a better interference-fit relationship between the wedges, the end of the tendon and the wall of the cavity of the anchor.

Another technique is described in U.S. Pat. No. 6,513,287, issued on Feb. 4, 2003 to the present inventor. This patent describes a method and apparatus for forming an anchorage of a post-tension system in which a tendon is positioned within a cavity of the anchor such that an end of the tendon extends outwardly of the cavity. A plurality of wedges are mechanically inserted within the cavity between the tendon and a wall of the cavity. Pressure is applied to an end of the tendon such that the tendon and the wedges are in interference-fit relationship within the cavity. A compression mechanism has a cylindrical member and a plunger extending in a channel of the cylindrical member. The wedges are attached to the cylindrical member and the cylindrical member is moved toward the cavity such that the wedges enter a space between the tendon and the wall of the cavity. The plunger applies a compressive force to the end of the tendon when the end of the tendon is in the channel of the cylindrical member.

One of the problems with conventional dead-end anchorages is that the sheathing over the tendon has a tendency to shrink over time. The shrinkage is the result of various factors. One major factor is that the sheathing is formed over the tendon in an extrusion process. As such, the polymeric material used for the sheathing is relatively hot as it exits the extrusion process. Immediately after leaving the extrusion process, the tendon, along with the sheathing, are tightly wound around a spool. During shipment, the tight winding of the tendon around the spool will mechanically resist any shrinking of the sheathing over the lubricated exterior of the steel cable on the interior of the tendon. When the cable is unwound from the spool, these mechanical forces are released. As such, as the tendon is installed in an anchor, the relaxation of these mechanical forces will generally and slowly cause the sheathing to shrink over the length of the tendon. After the tendon is connected to a dead end anchorage, the end of the sheathing will tend to shrink slowly away from the dead end anchorage.

The problem that affects many anchorage system is the inability to effectively prevent liquid intrusion into this area of the unsheathed portion where sheathing shrinkage has occurred. In normal practice, a liquid-tight tubular member is placed onto an end of the tendon so as to cover an unsheathed portion of the tendon. The tubular member slides onto and over the trumpet portion of the encapsulated anchor so as to be frictionally engaged with the trumpet portion of the anchor. The opposite end of the tubular member will include a seal that establishes a generally liquid-tight connection with the sheathed portion of the tendon.

In the past, various patents have issued to the present inventor relating to such corrosion-protection tubes. These patents were developed for the purpose of accommodating the natural shrinkage of the sheathing over the lubricated cable. For example, U.S. Pat. No. 5,839,235, issued on Nov. 20, 1998 to the present inventor, describes a corrosion protection tube for a post-tension anchor system. A tubular body is affixed in snap-fit engagement with the trumpet portion so as to extend outwardly from the trumpet portion in axial alignment therewith. The tubular body has a seal at an end opposite the trumpet portion so as to form a generally liquid-tight seal with an exterior surface of the tendon. The tubular body has a notch formed on an exterior surface thereof. The trumpet portion has an inwardly extending surface. The inwardly extending surface engages the notch so as to form a generally liquid-tight connection. A collar extends around the tubular body on a side of the notch so as to be in close relationship to the end of the trumpet portion.

U.S. Pat. No. 6,631,596, issued on Oct. 14, 2003 to the present inventor, teaches another corrosion protection tube for use on an anchor of a post-tension anchor system. This corrosion protection tube has a connection portion at one end and a sealing portion on an opposite end. The anchor has a trumpet portion with a notch extending therearound. The connection portion includes an inwardly extending surface for engagement with the notch of the trumpet portion. The sealing portion is in liquid-tight engagement with the sheathed portion of the tendon. Alternatively, the connection portion includes an additional inner sleeve so as to define an annular slot with the inwardly extending surface. The inner sleeve extends into the interior of the trumpet portion so that the inner sleeve and the trumpet portion are in a liquid-tight engagement.

U.S. Pat. No. 6,817,148, issued on Nov. 16, 2004 to the present inventor, describes another type of corrosion protection seal for the anchor of a post-tension anchor system. A seal member is affixed to an end of the tubular portion of the anchor opposite the anchor body. The seal member has a portion extending around the sheathed portion of the tendon in generally liquid-tight relationship therewith. The tubular portion has an interlock area extending therearound for engaging an interior surface of the seal member. The tubular portion has a length of generally greater than four inches extending outwardly of the anchor body.

U.S. Pat. No. 5,770,286, issued on Jun. 23, 1998 to the present inventor, shows a corrosion inhibitor retaining seal. This seal includes a cap having a tubular body and a surface extending across the of the tubular body. A corrosion-resistant material is contained within the interior area of the cap. This surface closes the end of the tubular body. A frangible area is formed on this surface The surface extends transverse to a longitudinal axis of the tubular body at one end of the tubular body. The frangible area has a thickness less than a thickness of a non-frangible remainder of the surface. The cap is formed of a polymeric material. The surface is formed of a deformable polymeric material such that the non-frangible portion of the surface forms a liquid-tight seal with an outer diameter of a tendon extending through the surface. The corrosion-resistant material is contained within the cap of a suitable volume so as to fill a void in the tubular member between the inner diameter of the tubular member and the outer diameter of a tendon extending therethrough.

U.S. Pat. No. 6,098,356, issued on Aug. 8, 2000 to the present inventor, shows a method and apparatus for sealing an intermediate anchorage of a post-tension system. This apparatus has a cap with an attachment section thereon. The attachment section is adapted to allow the cap to be connected to an end of the anchor body. The cap has a tubular member extending outwardly from the attachment section. The tubular member has an opening at an end opposite the attachment section. The cap also has a grease fitting formed thereon. The grease fitting is adapted so as to allow grease to be introduced into the interior passageway of the tubular member. The attachment section and the tubular member are integrally formed together of a polymeric material. A seal is affixed to the open end of the tubular member so as to form a liquid-tight seal over the sheathed portion of a tendon extending therethrough.

U.S. Pat. No. 6,381,912, issued on May 7, 2002 to the present inventor also shows a method of sealing the intermediate anchor of a post-tension system. An elastomeric seal has one end affixed to the anchor member and extending outwardly therefrom. A rigid ring member is detachably received within an opposite end of the seal. The ring member has an inner diameter greater than an outer diameter of the tendon. The opposite end of the seal is in liquid-tight compressive contact with the exterior surface of the tendon when the ring member is detached from the seal. The interior passageway of the anchor, the seal and the ring member have an inner diameter, when joined together, which is larger than the outer diameter of the tendon so as to allow the anchor member, the seal and the ring member to slide along the length of the tendon.

As can be seen, there is a great deal of technology associated with this need to accommodate the shrinkage of the sheathing over the cable of the tendon of the post-tension anchor system. Each of this technology suggests the placement of an additional tube over the polymeric encapsulation and additional materials for sealing the unsheathed portion of the tendon which extends outwardly of the anchor. In certain circumstances, these tubes are sometimes improperly installed and, at best, are simply an additional component that needs to be associated with the post-tension system. As such, it adds additional costs and can require additional labor associated with the installation of the sealing tube. As such, a need has developed so as to avoid the use of such a tube with the dead-end anchor of a post-tension anchor system.

It is an object of the present invention to provide a device which effectively prevents shrinkage of the sheathing at the dead-end anchor of a post-tension anchor system.

It is another object of the present invention to provide a device that can be easily installed during the installation of the wedges associated with the dead-end anchorage of a post-tension anchor system.

It is a further object of the present invention to provide a device which effectively engages the sheathing at the dead-end anchorage so as to resist shrinkage forces associated with the sheathing.

It is still another object of the present invention to provide a device which resists the shrinkage of the sheathing of a tendon of a post-tension anchor system which is easy to install, relatively inexpensive and easy to manufacture.

These and other objects and advantages of the present invention will become apparent from a reading of the attached specification and appended claims.

BRIEF SUMMARY OF THE INVENTION

The present invention is a device for preventing the shrinkage of a sheathing at the dead-end anchorage of a post-tension anchor system. This device includes an anchor body having a cavity formed in an interior thereof, a tendon extending into the cavity, a pair of wedges in the cavity of the anchor body, and at least one wedge member in the cavity of the anchor body. The tendon has a sheathing extending at least partially thereover, a sheathed portion, and an unsheathed portion. The sheathed portion extends into the cavity of the anchor body. The pair of wedges are in engagement with the unsheathed portion of the tendon.

The wedge member is engaged with the sheathed portion and has a wide end and a narrow end, the wide end being adjacent to the pair of wedges. The wedge member is of a decreasing thickness from the wide end to the narrow end. The wedge member has an interior surface and an exterior surface. The interior surface is in compressive contact with the sheathing of the sheathed portion, and the exterior surface is in compressive contact with a wall of the cavity. The interior surface of the wedge member extends in generally parallel relation to the tendon. The exterior surface of the wedge member extends at an acute angle with relation to the interior surface.

The sheathed portion between the wedge member and the tendon has a thickness less than the thickness of a remainder of the sheathed portion. The compressive contact of the wedge member with the sheathing being suitable for retaining the sheathing against up to 150 pounds of pulling force.

The cavity of the anchor body has a tapered portion so as to have a wide end opening at one end of the anchor body and a narrow end interior of the anchor body. The cavity has a passageway extending from the narrow end so as to open at an opposite end of the anchor body. The wedge member is positioned in the passageway. The pair of wedges extend along the tapered portion of the cavity. The passageway has a generally constant diameter. The wedge member engages an end of the sheathed portion within the passageway.

DETAILED DESCRIPTION OF THE INVENTION

Figure 1:
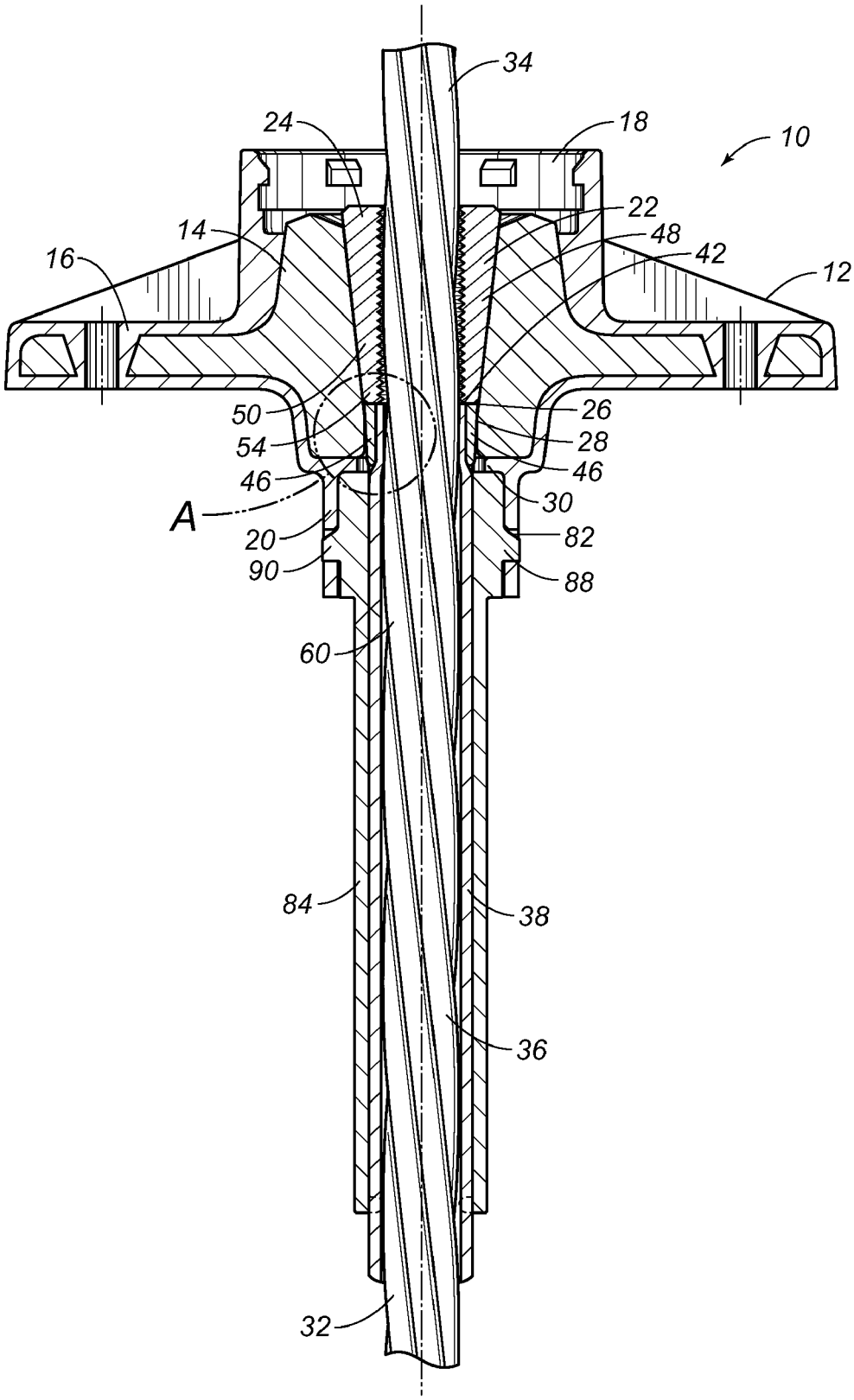
FIG. 1 is a cross-sectional view of the device of the present invention.

Referring to FIG. 1, there is shown the device 10 for the resisting of the shrinkage of a sheathing of a tendon in a post-tension anchor system. In particular, the device 10 shows the dead-end anchorage 12. The dead-end anchorage 12 includes an anchor body 14 with a polymeric encapsulation 16 extending thereover and therearound. A cap-receiving opening 18 is formed at one end of the polymeric encapsulation 16. A trumpet 20 is formed at the opposite end of the polymeric encapsulation 16. The trumpet 20 is a tubular section that extends outwardly of the end of the dead-end anchorage 12 for a short distance. The anchor body 14 is a steel anchor. The anchor body 14 has a cavity 22 formed in an interior thereof. The cavity 22 has tapered walls having a wide end 24 and a narrow end 26. The wide end 24 opens at an end of the anchor body 14. The narrow end 26 opens on the interior of the cavity 22. A passageway 28 extends from the narrow end 26 of cavity 22 to the opposite end 30 of the anchor body 14. The passageway 28 has a generally constant diameter. Wedges 48 and 50 extend along the tapered portion of the cavity 22 and are engaged with the unsheathed portion 34 of the tendon 32 in the cavity 22 of the anchor body 14.

A tendon 32 extends entirely through the cavity 22 of the anchor body 14. The tendon 32 also extends through the trumpet 20 of the polymeric encapsulation 16. Sheathing 38 extends over the tendon 32 so that the tendon 32 has an unsheathed portion 34 and a sheathed portion 36. Typically, a lubricant will be applied between the exterior surface of the tendon 32 and the inner surface 60 of the sheathing 38. The sheathed portion 36 of the tendon 32 extends into the cavity 22 of the anchor body 14.

The trumpet 20 includes a notch 82 extending around an interior thereof. The notch 82 receives a lip 90 of the connection portion 88 of a corrosion protection tube 84, which is in liquid-tight engagement with a surface of the sheathing 38. As such, the tube 84 effectively prevents liquid intrusion into the interior cavity 22 of the anchor body 14.

Referring still to FIG. 1, wedge members 44 and 46 are positioned in the passageway 28 of cavity 22. The wedge members 44 and 46 serve to engage with the end 42 of the sheathing 38 so as to strongly adhere the end 42 of the sheathing 38 within the passageway 28. Wedge members 44 and 46 generally abut the ends 54 of wedges 48 and 50, respectively, extending within the cavity 22.

Figure 2:
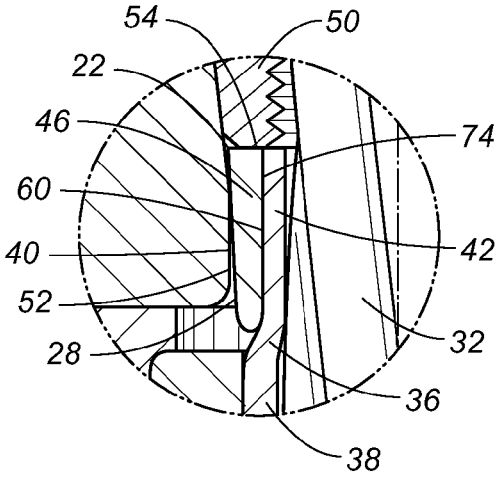
FIG. 2 is an enlarged cross-sectional view of the circled portion in FIG. 1, showing the relationship of the wedge members and the sheathing of the tendon.

FIG. 2 shows an enlarged cross-sectional view of the circled portion A in FIG. 1. As can be seen in FIG. 2, wedge member 46 is interposed between the outer surface 60 of the end 42 of the sheathing 38 and the wall 40 of the cavity 22. Wedge member 46 is urged into place by the action of the wedge 50 during installation. Wedge member 46 generally abuts the end 54 of wedge 50 extending within the cavity 22. The wedge member 46 exerts a compressive force on the outer surface 60 of the end 42 of the sheathing 38 which causes the end 42 of the sheathing 38 to be rigidly retained in compressive relationship between the interior surface 74 of the wedge member 46 and the surface of the tendon 32. As such, the end 42 of the sheathing 38 is fixedly retained within the passageway 28 of the cavity 22. Because of this fixed retention, any shrinkage effects are avoided at the dead-end anchorage 12 of device 10. Also noticeable is the sheathed portion 36 that is fixed between interior surface 74 of the wedge member 46 and the tendon 32 has a thickness less than the thickness of the remaining sheathed portion 36 that is not fixed in place. As can also be seen, the wedge member 46 has an inner diameter greater than the outer diameter of the sheathing 38.

This compressive contact is extremely effective in preventing the shrinkage of the sheathing 38. Typically, the force of shrinkage is between 100 and 150 pounds of pulling force. On the other hand, the force of the wedge members 44 and 46, as installed, will resist 30,000 pounds of force applied to the tendon 32. As such, although the engagement of the end 42 of sheathing 38 with the wall 52 the passageway 28 would appear to be rather weak, the forces are actually very strong as compared to those that are required in order to keep the sheathing 38 from shrinking.

Figure 3:
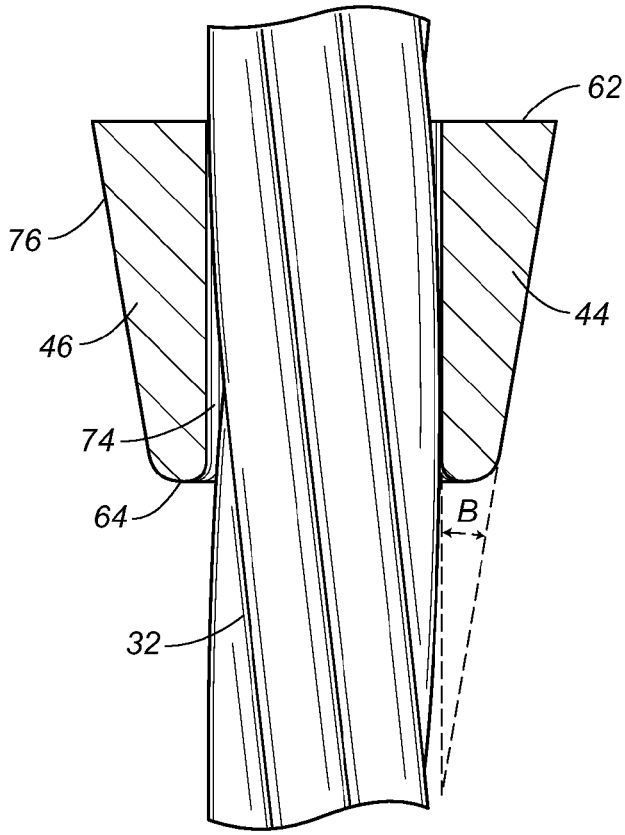
FIG. 3 is an isolated, cross sectional view of the wedge members of the present invention with a tendon therebetween.

FIG. 3 shows a cross-sectional view of the preferred embodiment of the wedge members 44 and 46 with a tendon 32 therebetween. As can be seen, the wedge members 44 and 46 have a wide end 62 and a narrow end 64. Each of the wedge members 44 and 46 have an exterior surface 76 and an interior surface 74. The interior surface 74 of each wedge member 44 and 46 is generally parallel to the tendon 32. The exterior surface 76 of each wedge member 44 and 46 is at an acute angle B in relation to interior surface 74. As can be seen, wedge members 44 and 46 of the preferred embodiment have a constantly decreasing thickness from wide end 62 to narrow end 64. It is also contemplated that the thickness decreases is other ways, such as an arcuate decrease in thickness from the wide end 62 to the narrow end 64.

Figure 4:
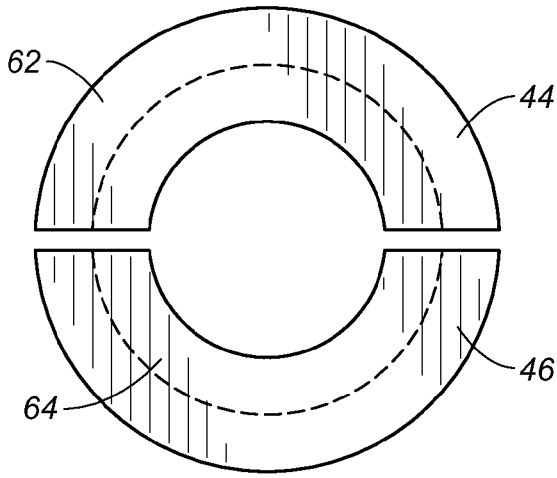
FIG. 4 is an end view of the wedge members of the present invention.

FIG. 4 shows an end view cross-section of the wedge members 44 and 46 of the present invention. As can be seen, the wedge members 44 and 46 have a generally semi-circular cross-section. The wide end 62 has a thickness greater than the narrow end 64. The tendon with its sheathing (not shown) extends between the wedge members 44 and 46. The semi-circular shape of the wedge members 44 and 46 optimizes the contact surface between the wedge members 44 and 46 and the sheathing 38 so as to fix the sheathing 38 and keep it from shrinking.

The wedge members 44 and 46 of the present invention are specially designed to have maximum compressive force where the narrow end 26 of the cavity 22 meets the passageway 28 of the cavity 22. In this way, the end 42 of the sheathing 38 is guaranteed not to shrink from the anchor body 14.

Each of the wedge members 44 and 46 extend generally around the diameter of the sheathing 38 so as to form a continuous compressive retaining relationship between the interior surface 74 of each wedge member 44 and 46 and the outer surface 60 of the sheathing 38 and a compressive retaining relationship between the exterior surface 76 of each wedge member 44 and 46 and the wall 52 of the passageway 28. Additionally, because of this encircling relationship of the wedge members 44 and 46 and the strong compressive-fit relationship between the end 42 of the sheathing 38 and the tendon 32, liquid intrusion into the cavity is effectively prevented. This relationship serves as a further "secondary" seal so as to prevent liquid intrusion.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A device comprising:

an anchor body having a cavity formed in an interior thereof, said cavity having a tapered portion so as to have a wide end opening at one end of said anchor body and a narrow end interior of said anchor body, said cavity having a passageway extending from said narrow end of said tapered portion so as to open at an opposite end of said anchor body, said passageway having a generally constant diameter;

a tendon extending into said cavity, said tendon having a sheathing extending at least partially thereover, said tendon having a sheathed portion and an unsheathed portion;

a pair of wedges in frictional engagement with said unsheathed portion of said tendon in said cavity of said anchor body; and at least one wedge member engaged with said sheathed portion, the wedge member having a wide end and a narrow end, said wide end being adjacent to said pair of wedges, the wedge member being of a decreasing thickness from said wide end to said narrow end, said wedge member having a portion positioned in said tapered portion of said cavity and another portion extending into said passageway, the wedge member for frictionally retaining an end of said sheathed portion within said passageway.

2. The device of claim 1, the wedge member having an interior surface and an exterior surface, said interior surface being in compressive contact with said sheathing of said sheathed portion, said exterior surface being in compressive contact with a wall of said cavity.

3. The device of claim 2, said interior surface of the wedge member extending in generally parallel relation to said tendon, said exterior surface of the wedge member extending at an acute angle with relation to said interior surface.

4. The device of claim 2, said sheathed portion between the wedge member and said tendon having a thickness less than the thickness of a remainder of said sheathed portion.

5. The device of claim 2, the compressive contact of the wedge member with said sheathing being suitable for retaining said sheathing against up to 150 p.s.i. of pulling force.

6. The device of claim 1, the wedge member having a generally semi-circular cross-section.

7. The device of claim 1, the wedge member having an inner diameter greater than an outer diameter of said sheathing.

8. A device comprising:

an anchor body having a cavity formed in an interior thereof;

a tendon extending into said cavity, said tendon having a sheathing extending at least partially thereover, said tendon having a sheathed portion and an unsheathed portion; and at least one wedge member engaged with said sheathed portion, the wedge member having a wide end and a narrow end, the wedge member having an interior surface and an exterior surface, said interior surface being in compressive contact with said sheathing of said sheathed portion, said exterior surface being in compressive contact with a wall of said cavity, said cavity of said anchor body having a tapered portion so as to have wide end opening at one end of said anchor body and a narrow end interior of said anchor body, said cavity having a passageway extending from said narrow end so as to open at an opposite end of said anchor body, the wedge member positioned in said passageway, said passageway having a generally constant diameter, the wedge member for frictionally retaining an end of said sheathed portion within said passageway.

9. The device of claim 8, further comprising:

a pair of wedges in frictional engagement with said unsheathed portion of said tendon in said cavity of said anchor body, said wide end of the wedge member positioned adjacent an end of said pair of wedges.

10. The device of claim 8, the wedge member being of a constantly decreasing thickness from said wide end to said narrow end.

11. The device of claim 8, said interior surface of the wedge member extending in generally parallel relation to said tendon, said exterior surface of the wedge member extending at an acute angle with relation to said interior surface.

12. The device of claim 8, said sheathed portion between the wedge member and said tendon having a thickness less than the thickness of a remainder of said sheathed portion.

13. The device of claim 8, the wedge member having a generally semi-circular cross-section.

14. The device of claim 8, the wedge member having an inner diameter greater than an outer diameter of said sheathing.

15. The device of claim 8, the compressive contact of the wedge member with said sheathing being suitable for retaining said sheathing against up to 150 p.s.i. of pulling force.

* * * * *